US006216594B1

(12) United States Patent
Nakano et al.

(10) Patent No.: US 6,216,594 B1
(45) Date of Patent: Apr. 17, 2001

(54) PLATE REPLACING SYSTEM

(75) Inventors: Takeaki Nakano; Kazuya Iyokawa, both of Higashi Katsushika-gun (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/207,258

(22) Filed: Dec. 9, 1998

(30) Foreign Application Priority Data

Dec. 16, 1997 (JP) ..... 9-345974

(51) Int. Cl.[7] ..... B41F 27/12
(52) U.S. Cl. ..... 101/477
(58) Field of Search ..... 101/415.1, 477

(56) References Cited

U.S. PATENT DOCUMENTS

| | | | | |
|---|---|---|---|---|
| 5,218,907 | * | 6/1993 | Komori et al. | 101/477 |
| 5,289,775 | * | 3/1994 | Spiegel et al. | 101/477 |
| 5,293,820 | * | 3/1994 | Maejima et al. | 101/477 |
| 5,406,888 | * | 4/1995 | Sugiyama et al. | 101/477 |
| 5,495,805 | * | 3/1996 | Beisel et al. | 101/477 |
| 5,526,747 | * | 6/1996 | Marmin et al. | 101/477 |
| 5,595,119 | | 1/1997 | Hada et al. | 101/477 |
| 5,617,792 | * | 4/1997 | Rau et al. | 101/477 |
| 5,671,674 | | 9/1997 | Nobuta et al. | 101/415.1 |
| 5,701,822 | * | 12/1997 | Metrope | 101/477 |

FOREIGN PATENT DOCUMENTS

| | | |
|---|---|---|
| 4140413A1 | 6/1993 | (DE) . |
| 62-74654A | 4/1987 | (JP) . |
| 3176149A | 7/1991 | (JP) . |
| 367023A | 10/1991 | (JP) . |

* cited by examiner

*Primary Examiner*—Stephen R. Funk

(57) ABSTRACT

A plate replacing system has a cassette capable of accommodating a new printing plate. The cassette is held at a fulcrum supported by a frame. A front end of the cassette turns about the fulcrum, and can contact and be retracted from a plate cylinder. Inside the cassette, an automatic mounting mechanism including long and short links and an air cylinder is provided for deforming the new plate so as to make a leading edge of the new plate bend. There is a gripping support side surface of a gap in the plate cylinder, which is parallel to the bend while moving a holding member, such as suction pads, which holds the leading edge of the new plate, from a waiting position to an inserting position.

11 Claims, 4 Drawing Sheets

PLATE REPLACING SYSTEM

FIELD OF THE INVENTION

The present invention relates to a plate replacing system of a rotary press, especially a web rotary press.

BACKGROUND OF THE INVENTION

Regarding a web rotary press having a plurality of printing units arranged ina row, various proposals have been made for a device which automatically attaches a predetermined printing plate, distributed to each fixed position of the plurality of printing units, to a predetermined position of each plate cylinder of the printing unit, and which automatically detaches the printing plate from the plate cylinder.

For example, Japanese Unexamined Patent Publication No. 74654/87 discloses a device using a robot provided with a hand having a sucking disk capable of holding a printing plate. Japanese Patent Publication No. 67023/91 shows a device comprising four interrelated base plates, coarse adjustment means provided on the first and second base plates so as to be capable of contacting and separating a printing plate with and from a predetermined position of a plate cylinder, printing plate fine adjustment means provided on the third and fourth base plates so as to be capable of properly placing a printing plate leading edge bend on a plate cylinder edge, printing plate holding means provided on the fourth base plate, means provided on the fourth base plate for bending a printing plate body along a circumferential surface of the plate cylinder, and means provided on the fourth base plate for pressing a trailing edge bend of the printing plate. Japanese Unexamined Patent Publication No. 176149/91 by the present applicant proposes a sheet-feed printing press in which a loader (cassette) capable of holding new and old printing plates is pivotably supported between printing units.

The former two devices require meticulous actions, and need a predetermined mechanism for each action. Thus, their structures have to be complicated, thereby inducing cost increases, and making the devices unreliable. The latter device, on the other hand, has a mechanism linked to a plate winding mechanism of a plate cylinder, and needs a predetermined mechanism for each action, as do the former two devices. This device also makes the structure of the loader complicated, thus involving an increased cost and prolonged actions.

SUMMARY OF THE INVENTION

It is an object of the present invention to provide an inexpensive plate replacing system having a simplified structure and capable of smoothly mounting a printing plate on a plate cylinder to shorten the plate replacing time.

To attain the above object, the present invention provides a plate replacing system comprising a cassette capable of accommodating a printing plate and supported so as to be pivotable, the cassette being contactable with and separable from a plate cylinder, and a printing plate moving mechanism provided in the cassette for holding the printing plate and moving the printing plate such that a bent front end surface formed at a leading edge front end portion of the printing plate becomes nearly parallel to a gripping support side surface of a plate cylinder gap.

The printing plate moving mechanism may deform the printing plate.

The printing plate moving mechanism may comprise a holding member for holding the printing plate, a link mechanism for supporting the holding member, and an actuator for driving the holding member via the link mechanism.

A pivot fulcrum of the cassette may be placed on a line perpendicular to a line of extension of the gripping support side surface of the plate cylinder gap during mounting of the printing plate.

The cassette may be supported on a loader, and the loader may be provided so as to be movable in a cylinder shaft direction, and can be brought into await state toward an operating side of a printing press.

The cassette may be supported on the loader so as to be movable in a direction perpendicular to the cylinder shaft direction.

The cassette may include an old plate holding unit for holding the printing plate to be removed from the plate cylinder.

The old plate holding unit may have an actuator which engages a trailing edge of the printing plate to retract the printing plate into the cassette.

The cassette may also include a positioning member which contacts the plate cylinder to position the cassette relative to the plate cylinder.

The plate replacing system may further comprise a cassette pivotally driving unit for pivotally driving the cassette to a contacting position at which the cassette contacts the plate cylinder, a separating position at which the cassette separates from the plate cylinder, and an intermediate position located between the contacting position and the separating position.

According to the foregoing constitutions, actions for mounting and dismounting the printing plate are performed by the pivoting action of the cassette. Furthermore, mounting of the printing plate on the plate cylinder is carried out smoothly without the need to upsize the cassette, so that the duration of plate replacement can be shortened. Besides, the plate replacing system can be simplified because the driving device can be shared.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

A plate replacing system according to the present invention will now be described in detail by way of the following Example with reference to the accompanying drawings.

EXAMPLE

Figure 1:
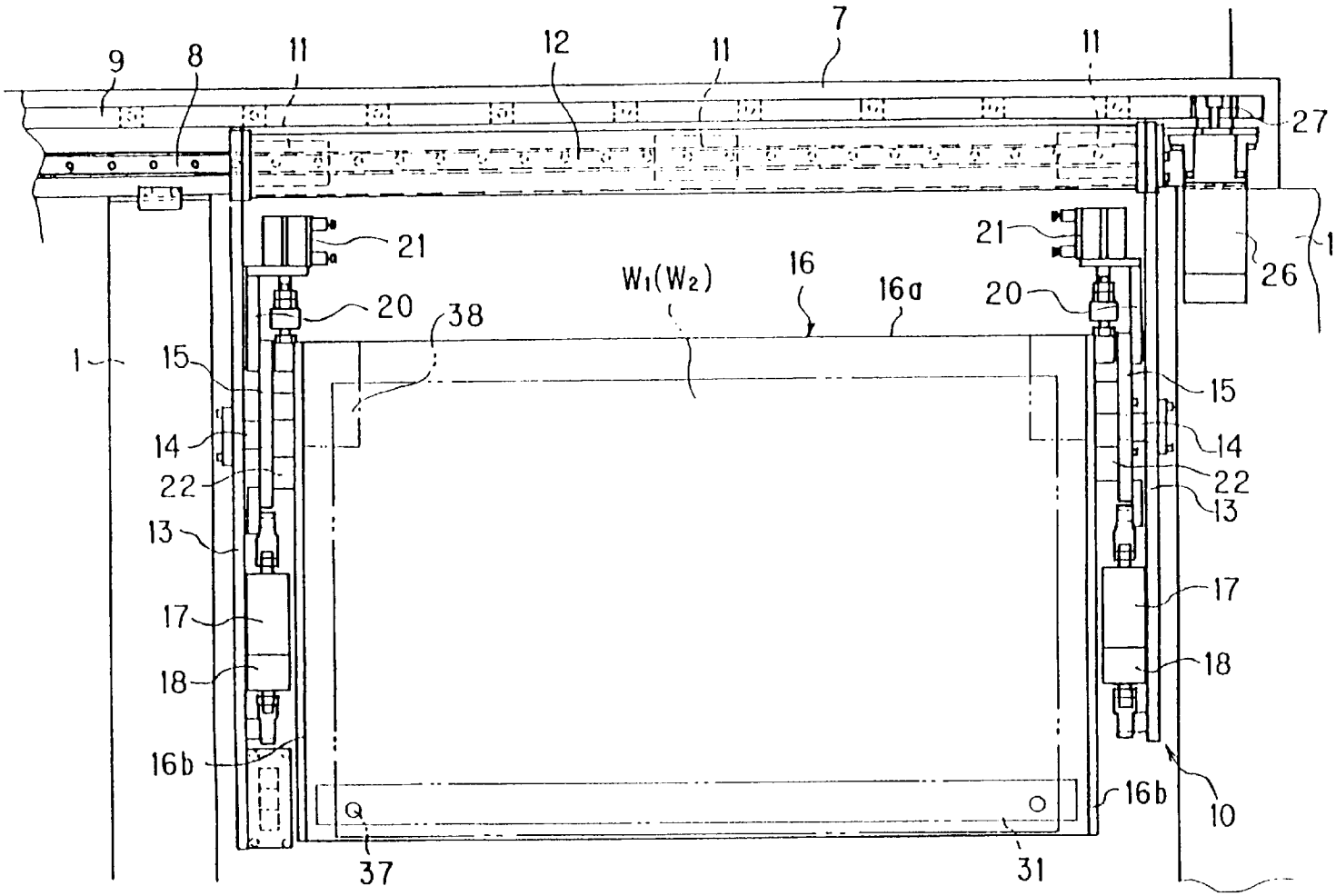
FIG. 1 is a front view of a plate replacing system showing an embodiment of the present invention.
Figure 2:
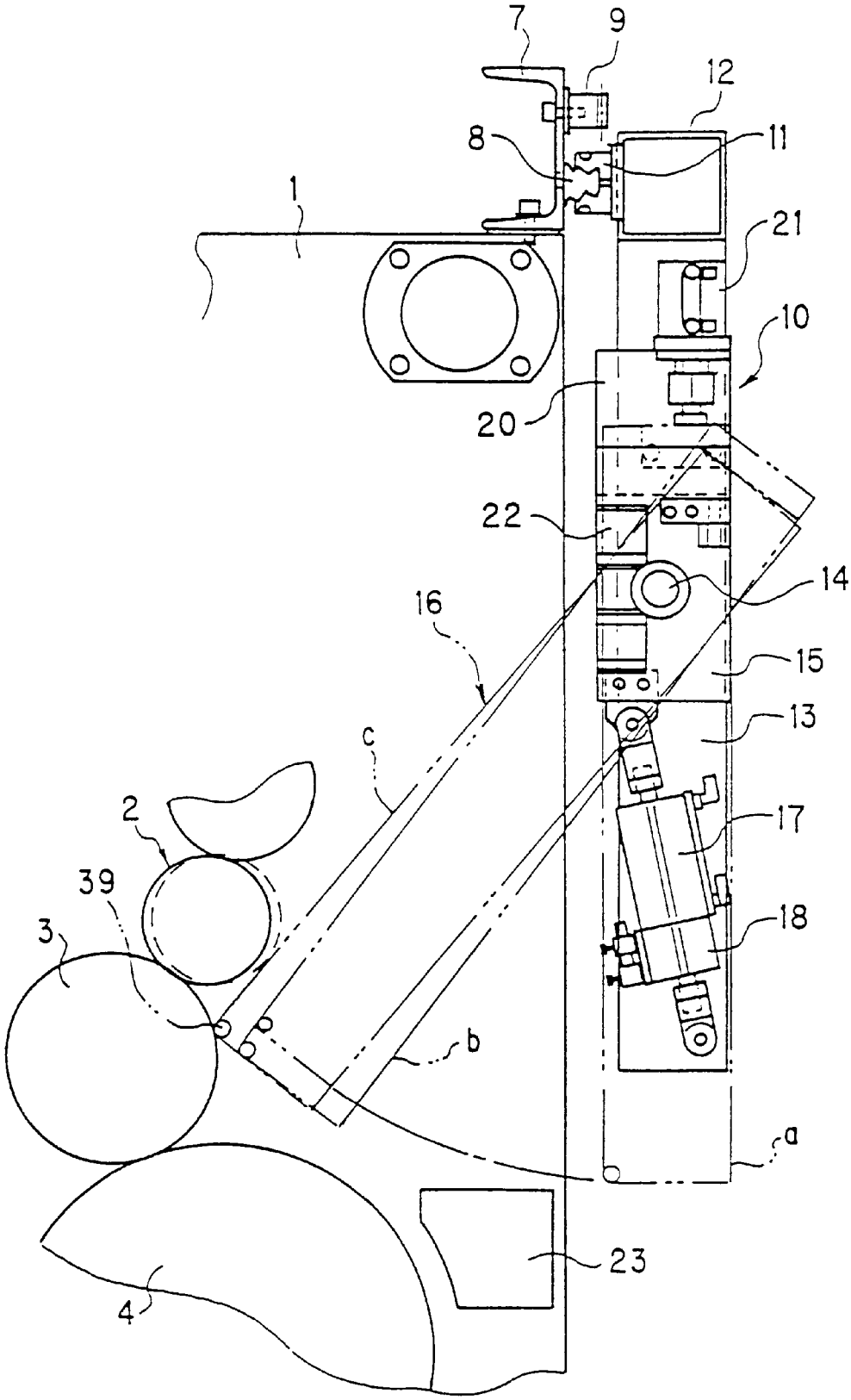
FIG. 2 is a side view of the plate replacing system.
Figure 3:
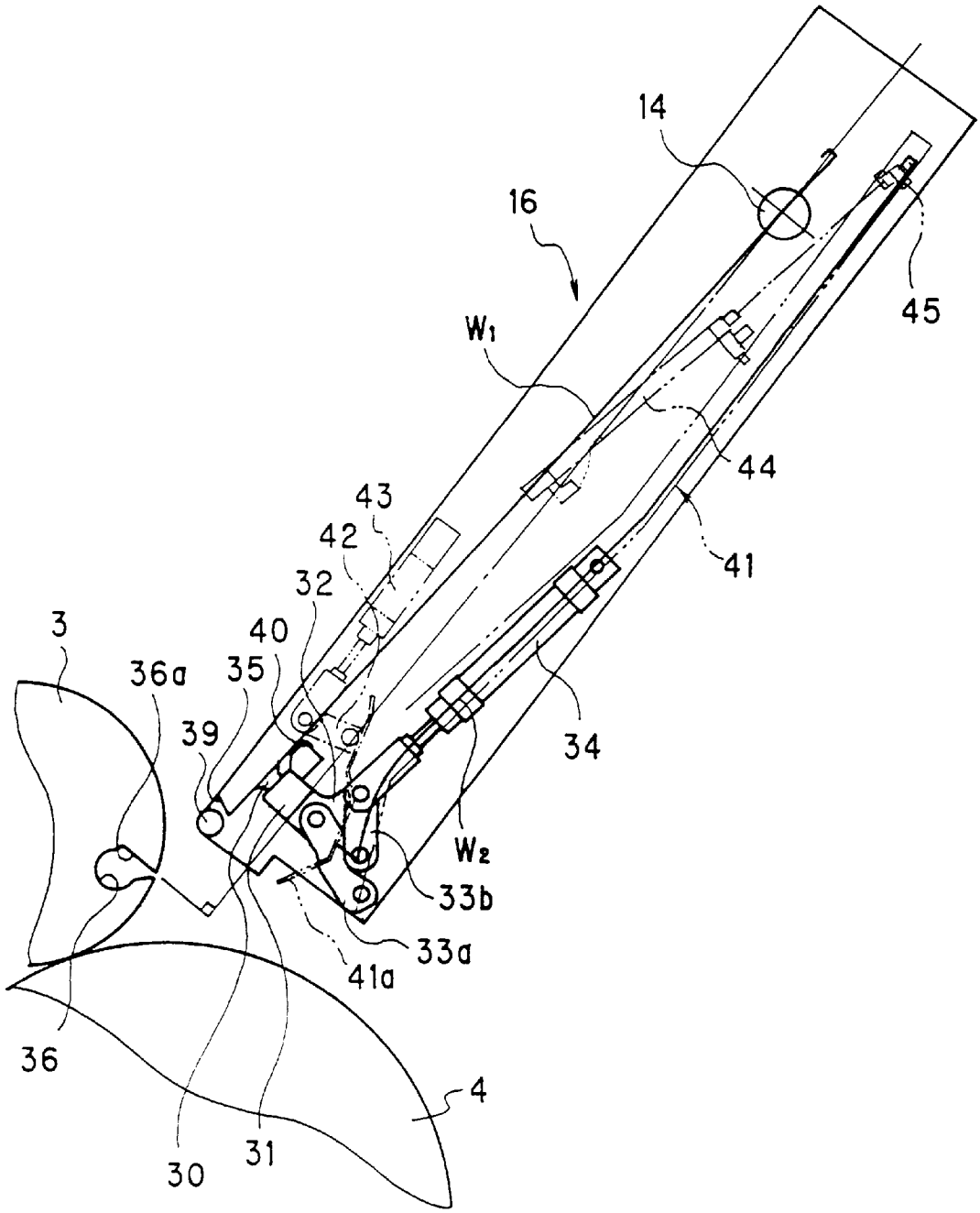
FIG. 3 is a structural explanation drawing of the interior of a cassette of the plate replacing system.
Figures 4A, 4B, 4C:
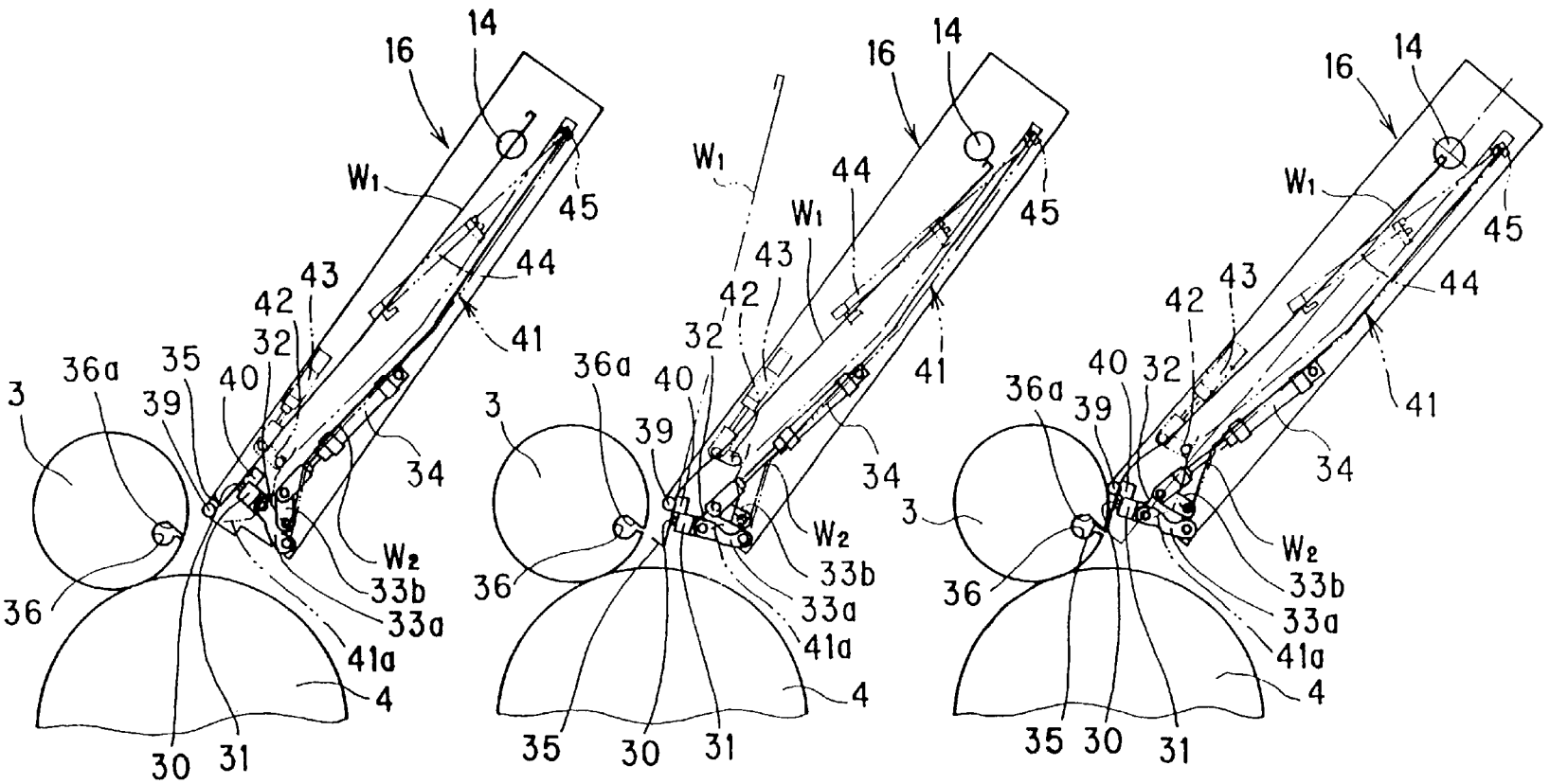
FIGS. 4(*a*) to 4(*c*) are explanation drawings of an operating state of the plate replacing system.

FIG. 1 is a front view of a plate replacing system showing an embodiment of the present invention. FIG. 2 is a side view of the plate replacing system. FIG. 3 is a structural explanation drawing of the interior of a cassette of the plate replacing system. FIGS. 4(*a*) to 4(*c*) are explanation drawings of an operating state of the plate replacing system.

As shown in FIGS. 1 and 2, ink rollers 2, a plate cylinder 3, and a blanket cylinder 4 are rotatably supported between right and left frames 1 of a web rotary press so that a web passing between the blanket cylinder 4 and a blanket cylinder (not shown) is printed. Needless to say, this set of cylinders arranged constitutes one printing unit, and a plurality of the printing units are arranged in a row in the direction of travel of the web, although this is not shown.

Between the upper surfaces of the right and left frames 1 corresponding to each printing unit, a channel bar 7 is provided to span the gap between these upper surfaces. One end of the channel bar 7 is projected over a predetermined length toward an operating side of the printing press (such that the length of the channel bar 7 exceeds the length between the right and left frames 1). On a side surface of, and over the entire length of, the channel bar 7, a rail 8 of a linear guide is laid. Above the rail 8, a rack 9 is fixedly provided parallel to the rail 8.

On the rail 8, a loader 10 for plate replacement for the plate cylinder 3 is held downwardly via a plurality of (three in the drawing) bearings 11 of the linear guide so as to be movable in a cylinder shaft direction. That is, the loader 10 runs below the rail 8.

The loader 10 suspends fixed frames 13 in a gate-like form from both ends of a stay 12 fixed to the bearings 11. On these fixed frames 13, moving frames 15 are turnably (pivotably) supported via pins (fulcrums) 14. Between these moving frames 15, a cassette 16 capable of accommodating new and old printing plates $W_1$ and $W_2$ is supported so as to be movable in a vertical direction (a longitudinal direction of the moving frame 15). Alternatively, a pin receiving member (hole) may be provided in the fixed frame 13, while a pin may be supported on the moving frame 15, so that the moving frame 15 can turn relative to the fixed frame 13.

In detail, a first air cylinder 17 for a long stroke and a second air cylinder 18 for a short stroke, whose suction heads are rigidly bonded to each other, are interposed between the fixed frame 13 and the moving frame 15 on each of the right and left frames 1. A front end of a piston rod of the first air cylinder 17 is pinned to a lower end portion of the moving frame 15, while a front end of a piston rod of the second air cylinder 18 is pinned to a lower end portion of the fixed frame 13.

When the first air cylinder 17 expands, the front end of the cassette 16 turns from a position a (starting point) to a position b (intermediate point) in FIG. 2. Based on this position b, the second air cylinder 18 expands and contracts, whereupon the front end of the cassette 16 turns in a reciprocating manner between the position b and a position c (end point) in FIG. 2.

At upper ends of the right and left moving frames 15, third air cylinders 21 for a short stroke are attached downwardly via brackets 20. A front end of a piston rod of the third air cylinder 21 is connected to an upper part of a side surface of the cassette 16. In the drawing, the reference numeral 22 denotes a linear guide interposed between the moving frame 15 and the cassette 16 for guiding the ascent and descent of the cassette 16.

When the front end of the cassette 16 turns between the position a and the position b in FIG. 2, the third air cylinder 21 is contracted to lift (retract) the cassette 16 slightly relative to the moving frame 15 (see a two-dot chain line in FIG. 2). As a result, the front end of the cassette 16 is prevented from interfering with a blanket cleaning device 23, etc. fixedly mounted on the frame 1.

On one of the fixed frames 13, a motor 26 for loader driving is mounted upwardly at an external upper position. A pinion 27 secured to an output shaft of the motor 26 is engaged with the rack 9.

The cassette 16 comprises a base plate 16*a*, and side walls 16*b* erected on the right and left sides of the base plate 16*a*. Inside the cassette 16, a moving mechanism for a new plate $W_1$ and holding unit for an old plate $W_2$ are provided which work in association with a publicly known plate winding mechanism (not shown; see Japanese Unexamined Patent Publication No. 66598/97) provided in the plate cylinder 3.

As the moving mechanism for the new plate $W_1$, a plurality of suction pads 30 (constituting a holding member, FIG. 3,) connected to a vacuum source (not shown) are provided in a front part of the interior of the cassette 16. The suction pads 30 are fixedly provided in a transverse row on a bar 31 (constituting the holding member) extending in a width direction of the cassette 16 to attract by suction and hold a leading edge of the new plate $W_1$. Reference holes 37 (see FIG. 1) formed at the leading edge of the new plate $W_1$ are the same as those widely used as positioning holes in plate making. A trailing edge of the new plate $W_1$ is suitably supported by stiffening plates 38 (see FIG. 1) provided on the side walls 16*b* of the cassette 16.

L-shaped brackets 32 are provided on lower surfaces of both ends of the bar 31. One end of each of two long and short links 33*a* and 33*b* is turnably supported on the side wall 16*b*. The other ends of the links 33*a* and 33*b* are turnably connected to and supported by the L-shaped bracket 32 so as to be adjacent to each other. To the point of connection of the L-shaped bracket 32 to the short link 33*b*, a front end of a piston rod of an air cylinder (as an actuator) 34 is connected, the air cylinder 34 being attached forwardly to an inner surface of each of the right and left side walls 16*b* of the cassette 16.

Upon expansion and contraction of the two air cylinders 34, the holding member including the suction pad 30, etc. reciprocates between a waiting position and an inserting position. Also, by setting the lengths of the long and short links 33*a* and 33*b* as well as the stroke amount of the air cylinder 34, the new plate $W_1$ can be deformed such that a leading edge bend 35 of the new plate $W_1$ (a front end portion of the plate at an acute bending angle) and a gripping support side surface 36*a* of a gap 36 of the plate cylinder 3, into which a winding rod or the like (not shown) is to be inserted at the time of mounting the printing plate, become nearly parallel to each other during the movement from the waiting position to the inserting position.

The fulcrum 14 of the cassette 16 is placed on a line perpendicular to a line of extension of the gripping support side surface 36*a* of the gap 36 in a state in which rotation of the plate cylinder 3 remains stationary at a mounting position of the new plate $W_1$.

As the holding unit for the old plate $W_2$, a guide plate 41 with a ⊐-shaped cross section having a front end portion widened like a trumpet is provided inside the cassette 16 so as to be capable of accommodating the entire old plate $W_2$. This guide plate 41 may be provided such that there is one guide plate 41 near the inner surface of each of the right and left side walls 16*b* of the cassette 16. Alternatively, the guide plate 41 may be provided in the form of a single plate continuously extending in the width direction of the cassette 16.

According to the present embodiment, an upper front end portion of the guide plate 41 (facing the suction pad 30) assumes a divided form as a moving guide 41*a*. To the moving guide 41*a*, front ends of piston rods of two air cylinders 43 attached forwardly to the inner surfaces of the right and left side walls 16*b* of the cassette 16 are turnably connected via support brackets 42. Upon expansion and contraction of the two air cylinders 43, the moving guide 41*a* is adapted to reciprocate between a waiting position and a guiding position.

To front ends of piston rods of two air cylinders 44 attached rearwardly to the inner surfaces of the right and left side walls 16*b* of the cassette 16, gripper members 45 are fixed. In withdrawing the old plate $W_2$ while gripping it, the two air cylinders 44 expand, whereupon the gripper members 45 hold a trailing edge of the old plate $W_2$ to impart tension to the old plate $W_2$.

In FIGS. 3 and 4(*a*) to 4(*c*), the reference numeral 39 denotes a roller provided at the front end of the cassette 16 so as to serve as a positioning member for the cassette. The reference numeral 40 denotes a guide roller provided on one side of the bar 31.

According to the foregoing constitution, the loader 10 is placed at a waiting position (outside the printing press) on a printing press operating side during ordinary printing (when the plate is not replaced). At this waiting position, the new plate $W_1$ is set in the cassette 16 by an operator's manual work. At this time, the new plate $W_1$ is held by the stiffening plates 38 and the suction pads 30 without being deformed, and thus can be set easily.

During replacement of the plate for switching of a printing product, operation of the printing press is stopped, and the motor 26 is started at the touch of a button by the operator, or by sequential control by a loader controller. As a result, the loader 10 runs along the rail 8 of the linear guide by the action of the rack 9 and the pinion 27, and is moved to a plate replacing position opposed to the plate cylinder 3 inside the printing press.

When the loader 10 reaches the plate replacing position and the motor 26 is stopped, the first air cylinder 17 of the loader 10 expands to turn the front end of the cassette 16 from the position a to the position b in FIG. 2. At this time, the third air cylinder 21 has been contracted, so that the cassette 16 has been slightly retracted relative to the moving frame 15. Thus, when the cassette 16 arrives at the position b, the third air cylinder 21 expands to push out the cassette 16 relative to the moving frame 15. Then, the second air cylinder 18 expands to turn the cassette 16 to the position c, thereby bringing the roller 39 into contact with the circumferential surface of the plate cylinder 3. At this position c, an automatic dismounting action for the old plate $W_2$ is started.

At the position c, the winding rod (not shown) of the plate cylinder 3 is loosened by operation of a lever (not shown) present in an end face part of the plate cylinder 3. On this occasion, the trailing edge of the plate is released from the circumferential surface of the plate cylinder under the plate's own elastic force, as shown in FIGS. 4(*a*) to 4(*c*). Then, when the plate cylinder 3 is rotated counterclockwise, the old plate $W_2$ is sequentially peeled from the circumferential surface of the plate cylinder, beginning at its trailing edge. While being peeled, the old plate $W_2$ enters the guide plate 41 of the cassette 16, and is eventually accommodated therein. At this time, the moving guide 41*a* lies at a guiding position indicated by a two-dot chain line in FIG. 4(*a*) because of the contraction of the air cylinder 43.

Meanwhile, the time comes when only a bend of a leading edge of the old plate $W_2$ is left in the plate cylinder 3. At this time, the air cylinder 44 expands, whereupon the gripper member 45 holds the trailing edge of the old plate $W_2$ to impart tension to the old plate $W_2$. After this tension impartment, the second air cylinder 18 contracts to turn the front end of the cassette 16 slightly toward a return side up to the position b.

As a result, the bend of the leading edge of the old plate $W_2$ is reliably withdrawn from the plate cylinder 3. Upon subsequent expansion of the air cylinder 44, the old plate $W_2$ is completely accommodated into the guide plate 41 of the cassette 16 (see a two-dot chain line in FIGS. 4(*a*) to 4(*c*)). After removal of the old plate $W_2$, an automatic mounting action for a new plate $W_1$ is started at the position b.

That is, as shown in FIGS. 4(*a*) to 4(*c*), the air cylinder 34 is expanded to project the leading edge of the new plate $W_1$ from the cassette 16 via the holding member such as the suction pads 30 (see FIGS. 4(*a*) to 4(*b*)). At this time, the moving guide 41*a* rests at a waiting position indicated by a two-dot chain line in FIG. 4(*b*) because of the expansion of the air cylinder 43.

On this occasion, the new plate $W_1$ is deformed, by setting the lengths of the long and short links 33*a* and 33*b* as well as the stroke amount of the air cylinder 34, such that the leading edge bend 35 of the new plate $W_1$ (the front end portion of the plate at an acute bending angle) and the gripping support side surface 36*a* of the gap 36 of the plate cylinder 3 become nearly parallel to each other at the time of mounting the printing plate.

Then, the second air cylinder 18 is expanded again to turn the front end of the cassette 16 from the position b to the position c. As a result, the leading edge bend 35 of the new plate $W_1$ held by the suction pads 30 is inserted into the plate cylinder 3 (see FIGS. 4(*b*) to 4(*c*)).

On this occasion, the leading edge bend 35 of the new plate $W_1$ and the gripping support side surface 36*a* of the gap 36 are nearly parallel to each other. In addition, the fulcrum 14 of the cassette 16 is placed on a line perpendicular to a line of extension of the gripping support side surface 36*a* of the gap 36 to bring the locus of the leading edge bend 35 close to the gripping support side surface 36*a* in a parallel manner. Thus, the leading edge bend 35 is smoothly inserted into the gap 36 without undue force.

Then, the sucking action of the suction pads 30 is released, and the plate cylinder 3 is slowly rotated clockwise (in a direction in which the new plate $W_1$ is delivered from inside the cassette 16), whereby the new plate $W_1$ is wound around the plate cylinder 3. When the new plate $W_1$ is entirely delivered from the cassette 16 and completely wound around the plate cylinder 3, the winding rod of the plate cylinder 3 is tightened by operation of the lever disposed in the end face portion of the plate cylinder 3.

After mounting of the new plate $W_1$, the second air cylinder 18 is contracted, and then the third air cylinder 21 is contracted again to retract the cassette 16 slightly relative to the moving frame 15. Afterwards, the first air cylinder 17 is contracted to turn and restore the front end of the cassette 16 to the position a.

The actions of the first to third air cylinders 17, 18 and 21 in the loader 10 and the actions of the air cylinders 34, 43 and 44 in the cassette 16 that have been performed up to this point may be carried out at the push of the button by the operator, or by sequential control relying on the loader and cassette controller.

Then, the motor 26 is started again at the operator's push of the button, or by sequential control by the loader controller. Consequently, the loader 10 travels along the rail 8 of the linear guide by the action of the rack 9 and the pinion 27, and is returned to the waiting position outside the printing press.

Then, the printing press is run to resume printing. In the loader 10, on the other hand, the discharged old plate $W_2$ is withdrawn from the cassette 16, and a new plate $W_1$ to be used next time is set in the cassette 16.

According to the present embodiment as described above, the loader 10 is placed in await state at the waiting position (outside the printing press) on an operating side of the printing press when the plate is not replaced. Compared with a wait on a drive side of the printing press under an untidy work environment, therefore, the operator needs less movement, and can move more easily, so that the working efficiency is improved.

Mounting of the new plate $W_1$ and dismounting of the old plate $W_2$ are performed by the same action, i.e., turning of the cassette 16. Thus, the first to third air cylinders 17, 18 and 21 can be shared, thus simplifying the plate replacing system.

The cassette 16 has an intermediate stopping position (position b). Thus, the gripping withdrawal of the old plate $W_2$ as well as the gripping insertion of the new plate $W_1$ can be performed by a minimum, necessary turning (pivoting) action, so that the operating time can be shortened.

During movement of the holding member such as suction pads 30 from the waiting position to the inserting position, the new plate $W_1$ can be deformed, by setting the lengths of the long and short links 33*a* and 33*b* as well as the stroke amount of the air cylinder 34, such that the leading edge bend 35 of the new plate $W_1$ and the gripping support side surface 36*a* of the gap 36 of the plate cylinder 3 become nearly parallel to each other at the time of mounting the new plate $W_1$. Thus, mounting work can be performed smoothly, without the need to upsize the cassette 16. Furthermore, the phase of the plate cylinder 3 is the same as the phase of the gripping withdrawal of the old plate $W_2$, so that the replacing time can be shortened.

In detail, to carry out the mounting work smoothly, a constitution may be conceived in which the leading edge bend 35 of the new plate $W_1$ is placed in the cassette 16 at an angle parallel to the gripping support side surface 36*a* of the gap 36 (see a two-dot chain line in FIG. 4(*b*)), and moved straightly. With this constitution, the cassette 16 for covering the new plate $W_1$ must be very large in size. With a constitution in which the new plate $W_1$ is mounted, in a deformed shape, inside the cassette 16, and moved parallel, on the other hand, the work of mounting the new plate $W_1$ to the cassette 16 becomes difficult.

According to the above embodiment, the new plate $W_1$ is deformed from the state of FIG. 4(*a*) into the state of FIG. 4(*b*). However, the same effect as in this embodiment can be obtained, even when a mechanism for moving the new plate $W_1$ from the state of FIG. 4(*a*) is provided to move it to the position of the new plate $W_1$ indicated in the two-dot chain line of FIG. 4(*b*) without deforming it.

According to the present invention, there is provided the above-described plate replacing system comprising a cassette capable of accommodating a printing plate and supported so as to be pivotable, the cassette being contactable with and separable from a plate cylinder, and a printing plate moving mechanism provided in the cassette for holding the printing plate and moving the printing plate such that a bent front end surface formed at a leading edge front end portion of the printing plate becomes nearly parallel to a gripping support side surface of a plate cylinder gap. According to this system, mounting and dismounting of the printing plate are both performed by a cassette turning action. Mounting of the printing plate on the plate cylinder is also carried out smoothly without upsizing the cassette. Thus, the plate replacing time can be shortened. Moreover, the sharing of the drive device simplifies the printing press.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plate replacing system comprising:

a plate cylinder with a gap, the gap having a gripping support side surface, a cassette capable of accommodating a printing plate and supported so as to be pivotable, means for pivoting the cassette, said cassette being contactable with and separable from the plate cylinder, a printing plate moving mechanism provided in the cassette for holding the printing plate and deforming the printing plate so that a bent front end surface formed at a leading edge front end portion of the printing plate becomes substantially parallel to the gripping support side surface of the plate cylinder gap, and a line extending from a pivot fulcrum along the cassette is substantially perpendicular to a line of extension of the gripping support side surface of the plate cylinder gap during mounting of the printing plate.

2. The plate replacing system of claim 1, wherein the printing plate moving mechanism comprises a holding member for holding the printing plate, a link mechanism for supporting the holding member, and an actuator for driving the holding member via the link mechanism.

3. The plate replacing system of claim 1, wherein the cassette is supported on a loader, and the loader is provided so as to be movable in a plate cylinder shaft direction, and can be brought into a wait state toward an operating side of a printing press.

4. The plate replacing system of claim 1, wherein the cassette includes an old plate holding unit for holding the printing plate to be removed from the plate cylinder.

5. The plate replacing system of claim 4, wherein the old plate holding unit has an actuator which engages a trailing edge of the printing plate to retract the printing plate into the cassette.

6. The plate replacing system of claim 1, wherein the cassette includes a positioning member which contacts the plate cylinder to position the cassette relative to the plate cylinder.

7. The plate replacing system of claim 1, wherein the means for pivoting the cassette drives the cassette to a contacting position at which the cassette contacts the plate cylinder, a separating position at which the cassette separates from the plate cylinder, and an intermediate position located between the contacting position and the separating position.

8. The plate replacing system of claim 1, wherein the printing plate moving mechanism includes a short link and a long link with settable lengths and an air cylinder with adjustable stroke, the front end portion of the plate has a preformed acute angle, the acute angle located between the front end portion and a main surface of the printing plate and the printing plate moving mechanism deforms the plate, so that the front end portion of the plate becomes substantially parallel to the gripping support side surface of the plate cylinder gap.

9. A plate replacing system comprising:

a plate cylinder with a gap, a cassette capable of accommodating a printing plate and supported so as to be pivotable, means for pivoting the cassette, said cassette being contactable with and separable from the plate cylinder, a printing plate moving mechanism provided in the cassette for holding the printing plate and deforming the printing plate so that a bent front end surface formed at a leading edge front end portion of the printing plate becomes nearly parallel to a gripping support side surface of the plate cylinder gap, wherein with pivoting of the cassette, the front end portion of the printing plate is inserted into the plate cylinder gap.

10. The plate replacing system of claim 9, wherein a pivot fulcrum of the cassette is placed on a line perpendicular to a line of extension of the gripping support side surface of the plate cylinder gap during mounting of a printing plate.

11. A plate replacing system comprising:

a plate cylinder with a gap, a cassette capable of accommodating a printing plate and supported so as to be pivotable, means for pivoting the cassette, said cassette being contactable with and separable from the plate cylinder, a printing plate moving mechanism provided in the cassette for holding the printing plate and moving the printing plate so that a bent front end surface formed at a front end portion of the printing plate becomes substantially parallel to a gripping support side surface of the plate cylinder gap, said printing plate moving mechanism positioning the bent front end surface so as to be pointed substantially in a direction of a tangent to a locus of the front end portion of the plate during pivoting of the cassette, and wherein with pivoting of the cassette, the front end portion of the printing plate is inserted into the plate cylinder gap.

* * * * *